US005547186A

United States Patent [19]

Papp et al.

[11] Patent Number: 5,547,186

[45] Date of Patent: Aug. 20, 1996

[54] LIMITED SPACE GOLF DRIVING RANGE

[76] Inventors: Michael J. Papp, 54 Old Farm La.; Kevin W. Whalen, 6 Fir Dr., both of New Milford, Conn. 06776

[21] Appl. No.: 252,350

[22] Filed: Jun. 1, 1994

[51] Int. Cl.[6] ..... A63B 69/36

[52] U.S. Cl. ..... 473/168; 473/163

[58] Field of Search ..... 273/26 A, 181 F, 273/176 R, 410, 181 R, 35 B, 35 R, 32 R

[56] References Cited

U.S. PATENT DOCUMENTS

| | | | |
|---|---|---|---|
| 1,669,640 | 5/1928 | Warlick | 273/181 F |
| 2,823,034 | 2/1958 | Bingham | 273/26 A |
| 3,222,067 | 12/1965 | Litwhiler et al. | 273/26 A |
| 3,602,506 | 8/1971 | Gentiluomo . | |
| 3,797,827 | 3/1974 | Child . | |
| 3,826,501 | 7/1974 | Hiromachi | 273/182 R |
| 3,897,947 | 8/1975 | Heffley, Jr. . | |
| 4,948,141 | 8/1990 | Newman . | |
| 5,052,688 | 10/1991 | Shiau . | |
| 5,178,384 | 1/1993 | Gorman | 273/410 |
| 5,205,564 | 4/1993 | Lamberti et al. . | |
| 5,332,224 | 7/1994 | Libit et al. | 273/35 B |

FOREIGN PATENT DOCUMENTS

| | | | |
|---|---|---|---|
| 2661103 | 10/1991 | France | 273/181 F |

*Primary Examiner*—Mark S. Graham

*Attorney, Agent, or Firm*—Ware, Fressola, Van Der Sluys & Adolphson

[57] ABSTRACT

A limited space enclosed driving range is provided having a field, a multiplicity of golfing bays, golf bay enclosing netting, a golf ball collection device and an enclosure raising, holding and lowering device. The multiplicity of golfing bays from which golfers hit golf balls is arranged on a front part of the field. The golf bay enclosing netting has three side nets that surround the field and has a top net that extends over the field and above the multiplicity of golfing bays for substantially enclosing the field and the multiplicity of golfing bays to contain golf balls being hit by the golfers. The golf bay enclosing netting is made from material that is lightweight, durable and flexible enough to contain the golf balls being hit by the golfers. The golf ball collection device for collecting golf balls being hit by the golfers is arranged on a back part of the field. The enclosure raising, holding and lowering device is adapted for lifting and holding the top net over the field and above the multiplicity of golfing bays and for lowering the top net onto the field to perform maintenance and prevent the top net from being damaged by high wind, heavy snow and ice accumulation.

5 Claims, 6 Drawing Sheets

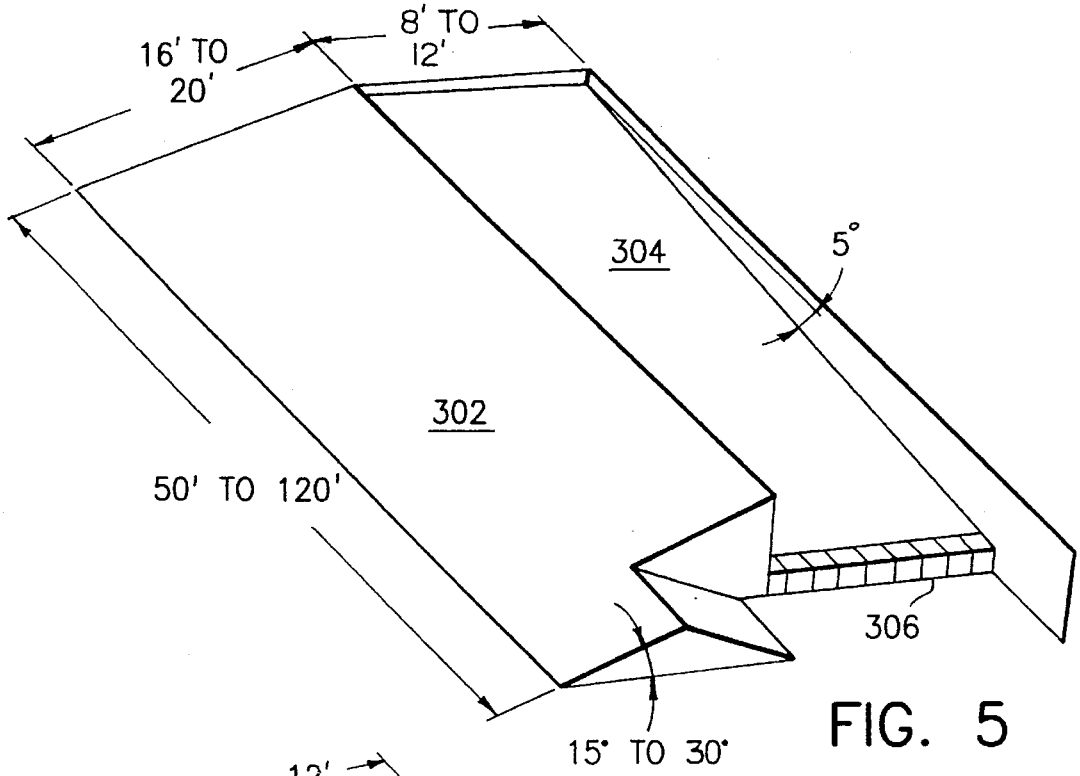
FIG. 5
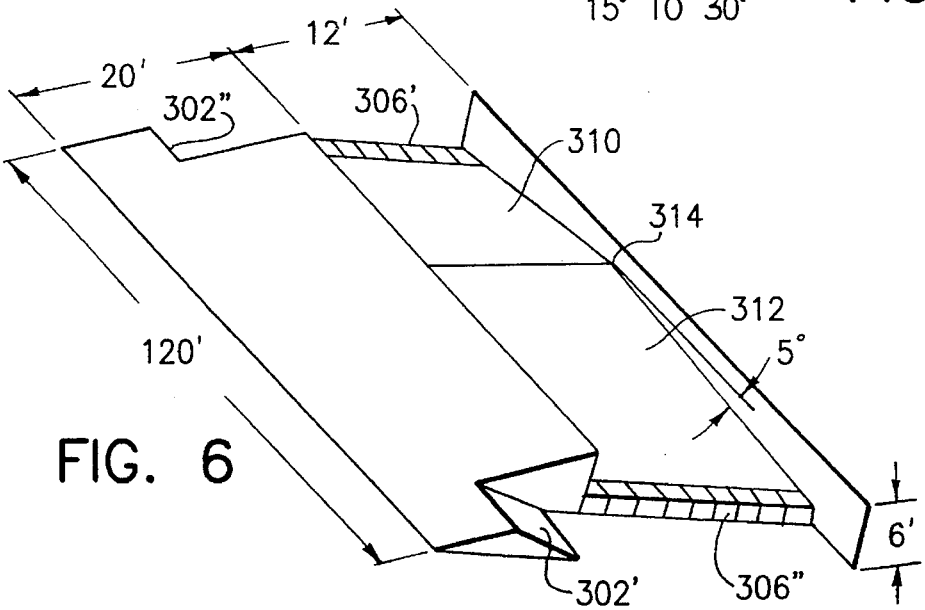
FIG. 6
FIG. 6a
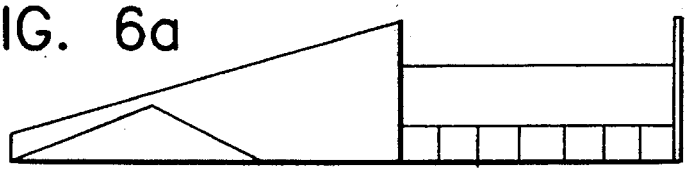

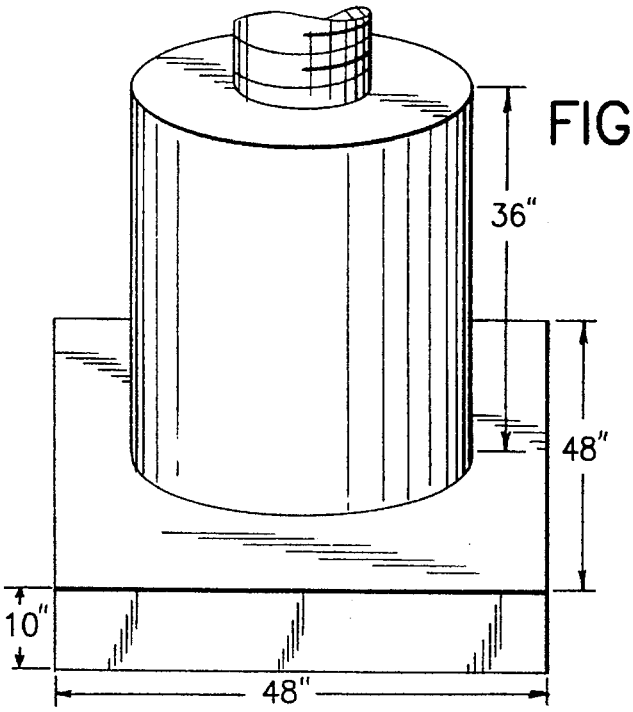
FIG. 7
FIG. 8
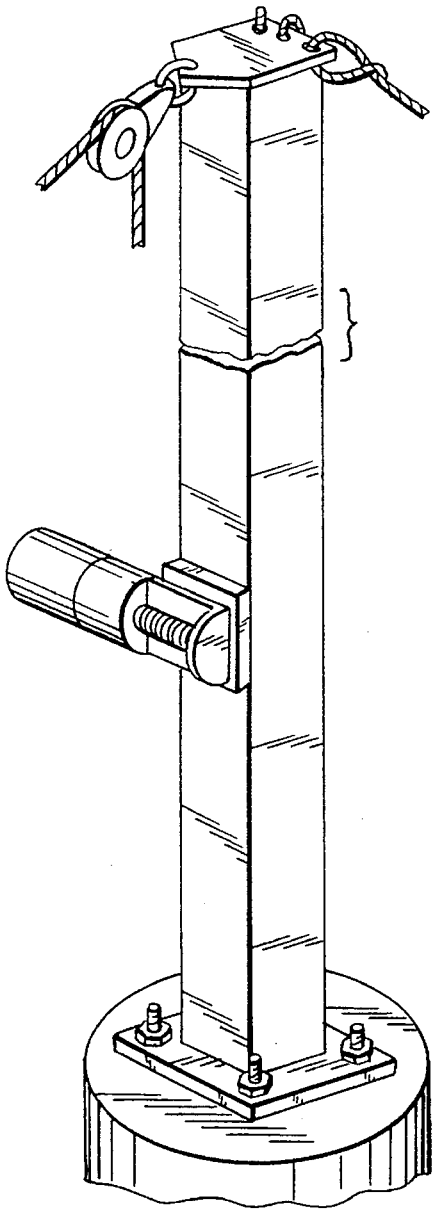

LIMITED SPACE GOLF DRIVING RANGE

This invention relates a golf driving range and, more particularly, to a limited space golf driving range having a top netting enclosure which can be raised and lowered, and having an automatic ball retrieving system with no moving parts.

BACKGROUND OF THE INVENTION

There are many different types of known driving ranges. For example, U.S. Pat. No. 3,602,506, issued to Gentiluomo, discloses a golf driving range having side walls 2 and 3, a tarpaulin backstop 5, and a suspension-type ceiling 6 as best shown in FIG. 2. The golf driving range also includes a mechanical conveyor-like ball collecting device having a downwardly inclined floor 7, a retrieving gutter 8 at the base of the tarpaulin backstop 5, a return conveyor 16, and an elevator loading hopper 20. U.S. Pat. No. 3,797,827, issued to Child, discloses a golf ball driving range shown generally in FIG. 2 for constructing over a lake having fence sections 36 adapted to be raised and lowered independently of each other. As shown in FIG. 4, each fence section 36 includes a flexible wire grid section 56 supported by posts 38, wire cables 52 and 54 and guy lines 40 as shown in FIGS. 1 and 4. The flexible wire grid section 56 is raised and lowered by winch drum 110 secured to the bottom of post 38 as shown in FIGS. 4–6 and described in also column 5, lines 1–42. The winch drum system pulls cables 52 by way of line 116 and pulling head 96, as described in column 5, lines 1–11, for raising and lowering the flexible wire grid 56. The fence sections 36 do not include a top fence section so ball can fly out of the driving range. In addition, Child's golf ball driving range includes a very complicated mechanical ball retrieving system as shown in FIGS. 3 and 7–31. U.S. Pat. No. 3,897,947, issued to Heffley, Jr., discloses a driving range with individual booths 22, screen barriers 30 and 32, a fairway 12 that is sloped towards the middle where an alley 20 collects balls, and a fairway surface overlaid with astro turf, as shown in FIGS. 1–3 and described in columns 6 and 7. U.S. Pat. No. 4,948,141, issued to Newman, discloses a circular golf practice arena generally shown as 5 having central tee positions 6 and circumferential targets 7 as best shown in FIGS. 1 and 3. FIG. 2 shows one section enclosed by internal walls 9, a roof 10 and an inclined dihedraled floor 13 for returning balls back to the golfer, as shown in FIGS. 1 and 2, and described in column 2, lines 45–52. The walls 9, roof 10, and target ends 8 may be made of flexible netting, column 2, lines 21–31. U.S. Pat. No. 5,052,688, issued to Shiau, discloses an automatic golf practice course with tee area 3 and target area 2 bounded by a net 21 as shown in FIG. 1 and covered by artificial grass 25, as described in column 2, lines 1–5. U.S. Pat. No. 5,205,564 discloses a ball catching net apparatus which uses a winch assembly 72 to raise and lower the net frame members 58 and 60 as shown in FIG. 9 and described in column 4, lines 5–26. Finally, expansive multi-decked driving ranges are also known which are enclosed on three sides and the top and require golf balls to be retrieved by a worker driving a ball retrieving machine.

SUMMARY OF THE INVENTION

The invention features a limited space driving range that can be used at golf courses which either do not have room for conventional driving range or desire to eliminate the cost associated with the conventional driving range which requires a person to constantly retrieve golf balls from the range and surrounding areas and the continuous replenishment of the golf ball supply. The driving range concept can also be used as a stand alone outdoor recreational device for public use in local and county parks or for private use in a backyard with one or two golf bays.

The driving range concept features an enclosed driving area surrounded on 4 sides by a fence and covered by a top netting. The top netting is raised and lowered to minimize the adverse affects caused by strong wind. The top netting is adapted on 8 utility poles, including 3 rear utility poles, 2 side-center utility poles, and 3 front utility poles, and is connected by a respective wire passing through an associated pulley to a corresponding winch. The top netting can act like a sail when subjected to strong wind conditions, because of this, it is tapered, having a rear height of a bout 40' and a front height of about 20', maximizing the actual and perceived depth of the driving range while minimizing the ability of the wind to grab the netting. During high wind and rain conditions, the top netting must be lowered because it can rip or bend the utility poles from their desired upright positions.

In addition, the driving range concept further features a floor covered by outdoor carpet having an angled rear embankment separated from the rear netting by a rear channel. The angled rear embankment enhances the visual depth perception of the driving range. The rear channel has a sidewardly angled rear chute which operates as a ball retrieval system. In operation, golf balls hitting the rear netting or rolling over the angled rear embankment fall in the rear channel, roll down the sidewardly angled rear chute, and are collected in baskets.

The invention accordingly comprises the features of construction, combination of elements, and arrangement of parts which will be exemplified in the construction hereinafter set forth, and the scope of the invention will be indicated in the claims.

DESCRIPTION OF THE DRAWING

For a fuller understanding of the nature and objects of the invention, reference should be made to the following detailed description taken in connection with the accompanying drawings, in which:

FIG. 5 shows one embodiment of the ball collection means of the limited space driving range in FIG. 1.

FIG. 6 shows one embodiment of the ball collection means of the limited space driving range in FIG. 1.

FIG. *6a* shows a side view of the embodiment shown in FIG. 6.

Figure 1:
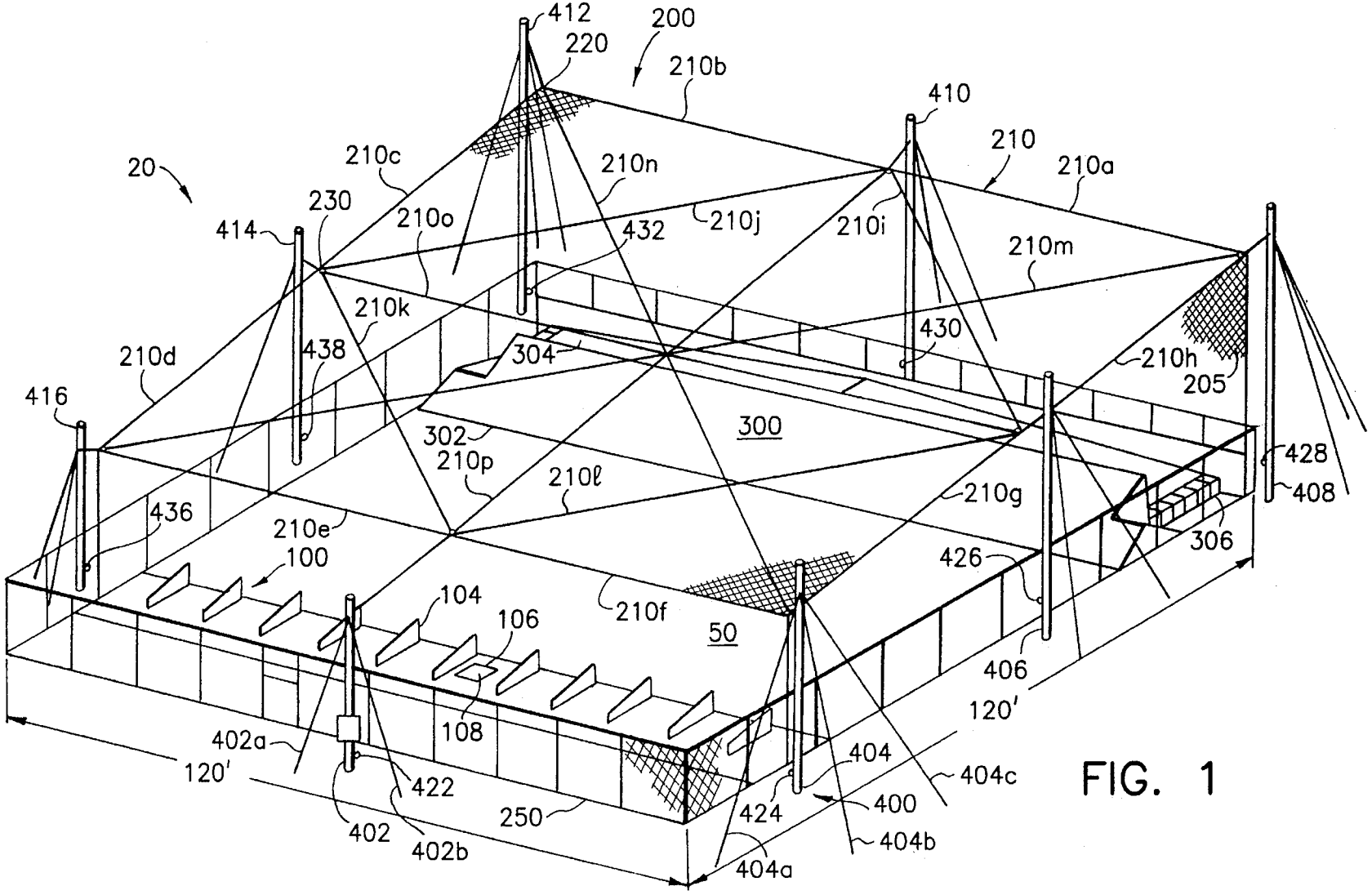
FIG. 1 shows a perspective view of a limited space driving range.

FIG. 7 shows a typical footing for the limited space driving range in FIG. 1.

FIG. 8 shows a steel pole assembly design for the limited space driving range in FIG. 1.

Figure 9:
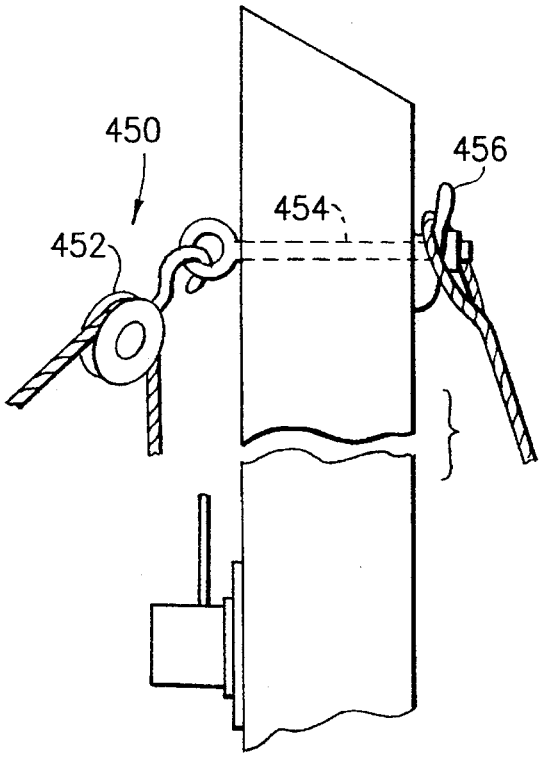

FIG. 9 shows a pulley block means for the limited space driving range in FIG. 1.

Figure 10:
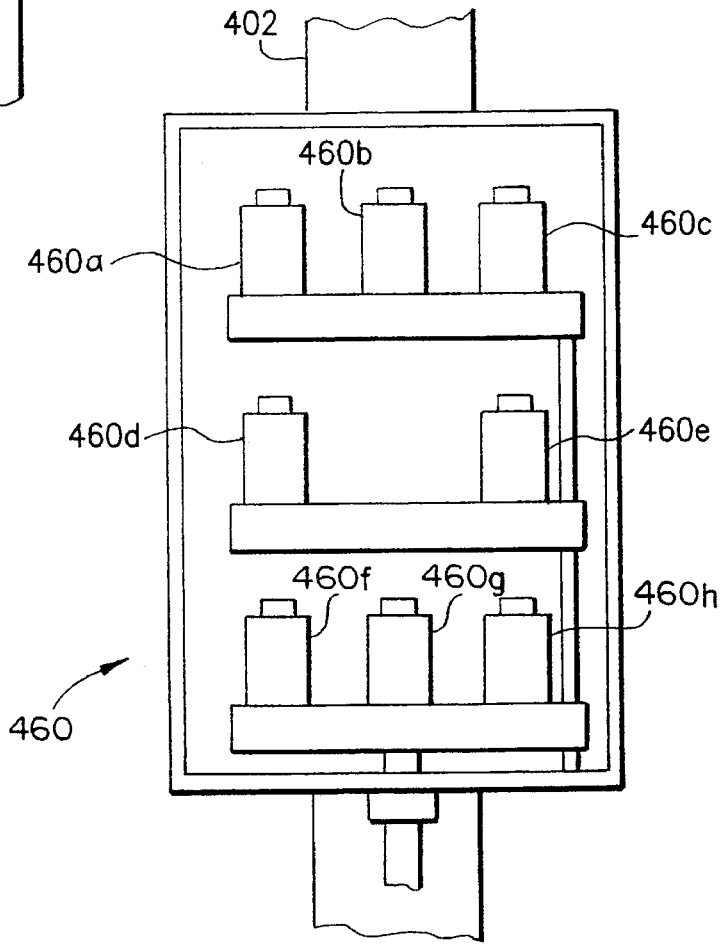

FIG. 10 shows a control panel for the limited space driving range in FIG. 1.

DESCRIPTION OF THE BEST MODE OF THE INVENTION

The Limited Space Enclosed Driving Range in General

As shown in FIG. 1, the invention features a limited space enclosed driving range generally indicated as 20, having four principal elements: (1) golfing bays 100, (2) golf bay enclosing means generally indicated as 200 which includes a netting 205 supported by a cable network 210 and a chain link fence 250 surrounding driving range 20, (3) golf ball retrieving means generally indicated as 300 for collecting golf balls, and (4) golf bay enclosure raising, holding and lowering means generally indicated as 400 which includes utility poles having winches electrically controlled for raising and lowering the netting 205.

A typical limited space enclosed driving range 20 as shown has a field 50 and is dimensioned about 120' by 120' and includes 12 golfing bays 100. The driving range is generally covered with indoor/outdoor carpet. The field and upwardly sloping ramps are covered with about 1,200 square yards and the walkway and hitting bays are covered with about 400 square yards spike proof carpet.

The limited space enclosed driving range 100 typically has a ball machine (not shown) for golfers to purchase balls by token or legal tender, which is refilled from time to time.

The Golf Bays Means 12

As shown in FIG. 1, the golfing bay means 100 typically includes 12 golf bays 102 separated by weather-proof partitions 104 where a golfer (not shown) can hit golf balls (not shown). A typical golf bay 102 has a golf range mat 106, preferably dimensioned 5' by 5' and made from artificial grass with a rubber tee 108. The typical golfing bay 102 is usually about 10 feet wide. The golf bays 102, the partition 104 and the golf ranging mat 106 are all known in the art.

The Top Netting and Cable Structure 200

Figure 2:
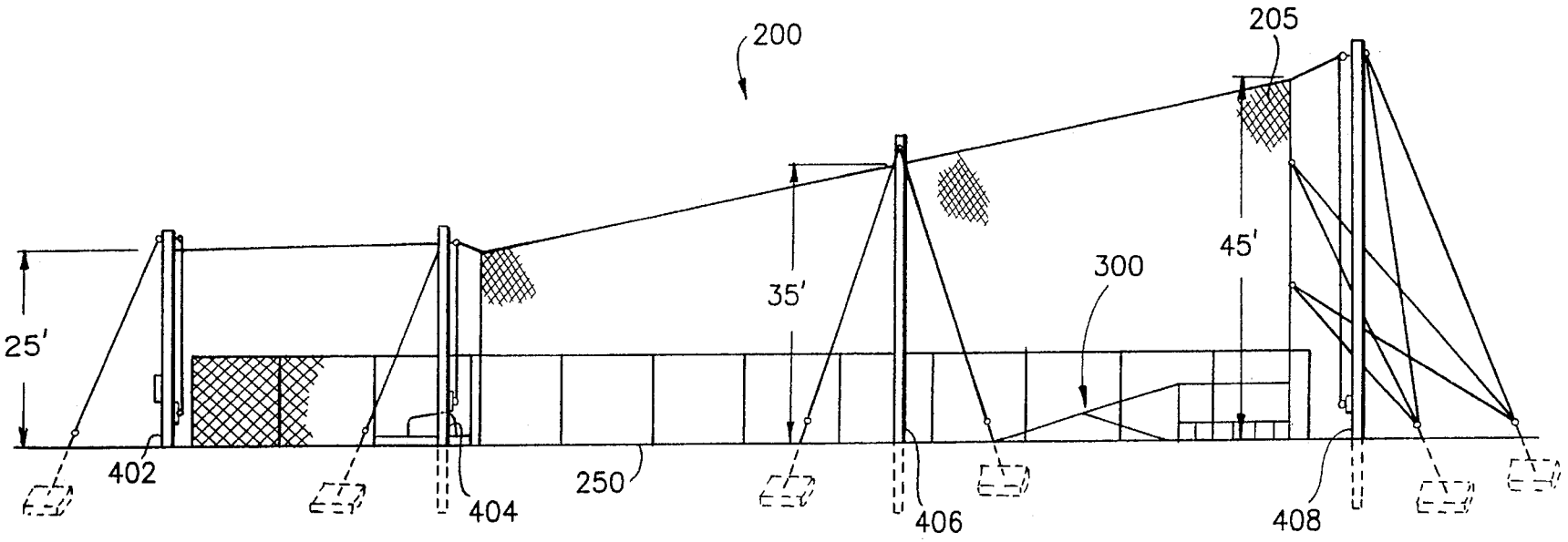
FIG. 2 shows a side view of the limited space driving range shown in FIG. 1.

As shown in FIGS. 1 and 2, the golf bay enclosing means 200 is a combined top netting and cable structure (205, 210) which encloses the 12 golfing bays 102. The top netting 205 has to be made from material that is both durable enough to stop and contain the golf balls being hit against it by the golfer and lightweight and flexible enough to be raised and held in place, and lowered when necessary such as to prevent it from being damaged by high wind, heavy snow and ice accumulation. For example, the top netting 205 is typically an integral netting structure supported by a cable network generally indicated as 210 which includes ¼" wire rope 210*a*, 210*b*, . . . , 210*o*, 210*p*. For a limited space enclosed driving range having dimensions of about 120' by 120', the top netting needs to be about 15,000 square feet. When ⅞" UV treated commercial grade impact netting is used, the netting weighs about 920 pounds. When supported by the cable network 210, as shown in the raised position in FIGS. 1 and 2, the netting includes two sides part 202, 204, a front part 206 and a top part 208.

Figure 3:
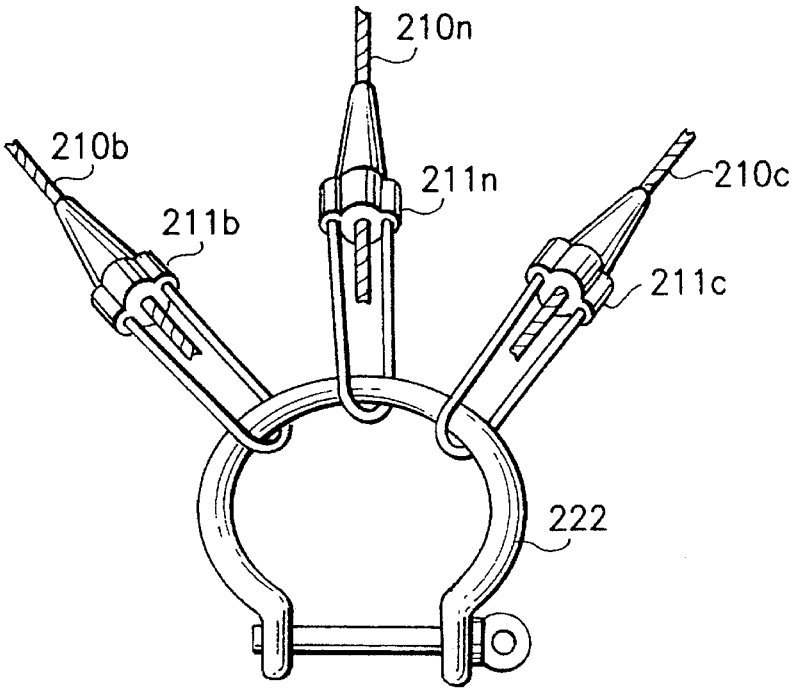
FIG. 3 shows a corner shackle web of the cable network in FIG. 1.

In each of the four corners of the cable network 210, one of which is generally indicated as 220, a respective corner shackle web 222 connects the cable structure 212 to the enclosure raising and lowering means in a manner discussed below. For example, FIG. 3 shows the corner shackles 222 which couple cables 210*c*, 210*b* and 210*n* with cable grips 211*c*, 211*b* and 211*n*.

Figure 4:
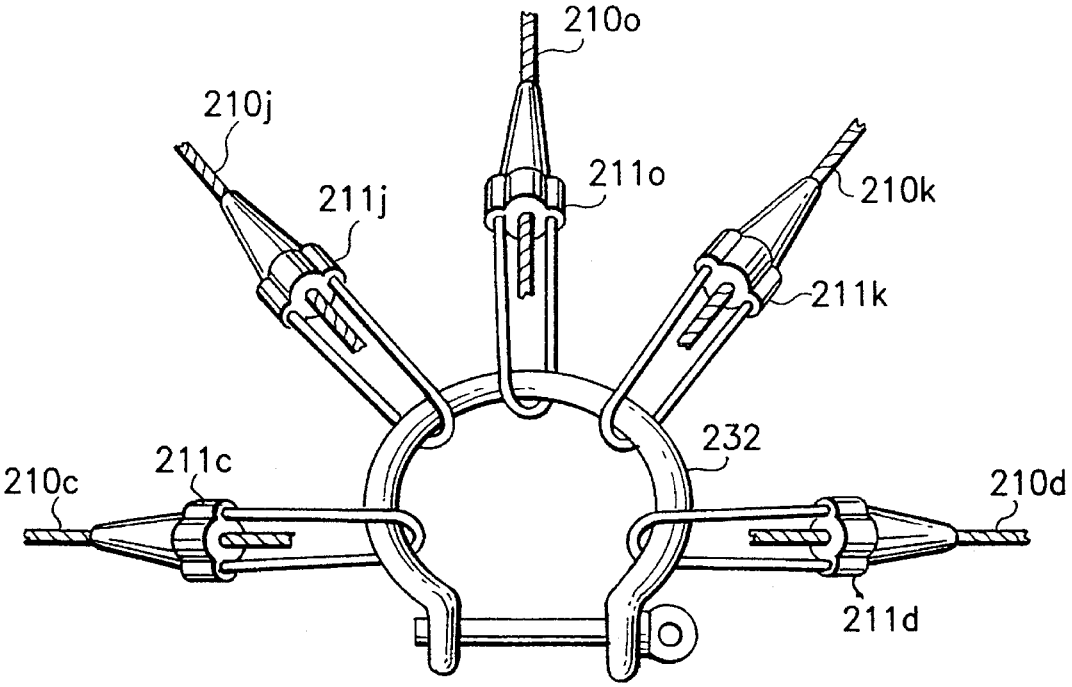
FIG. 4 shows a center shackle web of the cable network in FIG. 1.

In each of the four centers of the cable network 210, one of which is generally indicated as 230, a respective center shackle web 232 connects the cable structure 212 to the enclosure raising and lowering means in a manner also discussed below. For example, FIG. 4 shows the center shackles 222 which couple cables 210*c*, 210*d*, 210*j*, 210*k*, 210*o* with cable grips 211*c*, 211*d*, 211*j*, 211*k* and 211*o*.

The corner shackles 222 and center shackles 232 are ⅜" shackles and are known in the art.

The golf bay enclosing means 200 also includes a chain link fence 250 which surrounds the golf bays 100.

The Golf Ball Retriever 300

The limited space enclosed driving range 20 also includes golf ball retrieving means 300 arranged inside the netting for collecting golf balls hit by the golfers, as shown in FIGS. 5 and 6. The golf ball retrieving means 300 includes an upwardly sloping ramp 302 from front-to-back and a rear ball collection channel generally indicated as 304. The golf ball retrieving means 300 is typically made of plywood. After being hit, golf ball either roll over the upwardly sloping ramp 302, into the rear ball collection channel 304 and into the golf ball collection bins 306, or hit the front net and drop into the rear ball collection channel 304. One of the important advantages of the ball retrieval system is that it very effectively collects golf balls that are hit, has no moving parts, and requires no maintenance.

As shown, the upwardly sloping ramp 302 has a front-to-back width in a range of 6'–20' long, a length in the range of about 50' to 120', and has a front-to-back tangential slope in a range of 15 to 30 degrees. In the embodiment shown the front-to-back tangential slope is 22 degree, rising about 5' for every 12' in length. The upwardly sloping ramp 302 is covered with green artificial turf. The slope of the upwardly sloping ramp 302 imparts visual perspective to a golfer.

In FIG. 5, the rear ball collection channel 304 has one sidewardly sloping ramp 308 arranged behind the upwardly sloping ramp 302 and angled in a range of about 5–15 degrees. In the embodiment shown the angle is about 5 degrees. The collection bins 306 are disposed at the lower end of the sidewardly sloping ramp 306. As shown in FIG. 5, the upwardly sloping ramp 302 has a downwardly sloping portion on one side to make it easier to retrieve the golf balls from the collection bins 306.

FIG. 6 shows an alternative embodiment in which the rear ball collection channel 304 has two sidewardly sloping ramps 310, 312 arranged behind the upwardly sloping ramp 302 and a central peak 314, so balls roll down either side of said ball collection channel. The channel 304 is about 12' wide and has a sideward slope of in a range of about 5 to 15 degrees. As shown in FIG. 6, the upwardly sloping ramp 302 has two downwardly sloping portions 302', 302" one on each side to make it easier to retrieve the golf balls from the collection bins 306. The collection bins 306', 306" are disposed at the lower end of the two sidewardly sloping ramp 310, 312. FIG. 6*a* shows a side view of the embodiment.

The Netting Raising, Holding and Lowering Means 400

The limited space enclosed driving range 20 also includes an enclosure raising and lowering means 400 adapted for lifting, holding and lowering the netting and cable structure to install, maintain and prevent it from being damaged by high wind, heavy snow and ice accumulation.

As shown in FIG. 1, the enclosure raising and lowering means 400 includes 8 utility poles 402, 404, . . . , 416. The three back utility poles 408, 410, 412 are 50' in height, the two middle utility poles 406 and 414 are 40' in height, and the three front utility poles 402, 404, 416 are thirty feet in height. The 8 utility poles 402, 404, . . . , 416 preferably are arranged on standard concrete footings and can also be held in place by two or three guy wires 402*a*, 402*b*, 404*a*, 404*b*, 404*c*, . . . , etc.. The guy wires 402*a*, 402*b*, 404*a*, 404*b*, 404*c*, etc. are anchored to the ground by ¾" rod anchors which is known in the art. An example of a concrete footing is shown in FIG. 7 and is known in the art. The utility pole heights are chosen so the netting is higher in the back and lower in the front, in effect, providing a tapered depth of field for the golfer. The lowered front also makes is harder for a strong wind to blow under the netting and adversely pull on it. As shown in FIG. 2, the top of the netting is about 45', the middle about 35' and the front about 25'. The scope of the invention is not limited to these particular height or the heights of the particular poles. FIG. 8 shows an alternative embodiment using steel pole assembly, having for example, three 40' back utility poles each 8" by 8" by ⅜" (box tube), two 30' middle utility poles each 8" by 8" by ⅜" (box tube), and three 20' front utility poles each 8" by 8" by ⅜" (box tube).

As shown in FIGS. 1 and 9, the enclosure raising and lowering means 400 also includes winches 422, 424, . . . , 436 each respectively arranged on one of the 8 utility poles 402, 404, . . . , 416 for raising, holding and lowering the top netting 200 and cable network 210 and a respective pulley block means 450 (best shown in FIG. 9) mounted near the top of the utility pole. The winches 422, 424, . . . , 436 are 2,000 pound AC powered winches operating on 115 volts, although the scope of the invention is not intended to be limited to this particular model of winches. The pulley block means 450 is designed to hold a 2000 pound capacity and includes a pulley 452, an eyebolt 454 (⅝" by 16") passing through the utility pole, a cable hook 456 for receiving a guy wire as shown. The pulley block means 450 is known in the art. Each winch 422, 424, . . . , 436 is connected by ⅜" galvanized utility cable guys with 10,000 pound capacity through a respective pulley block means 450 to the corner shackle web 222 (FIG. 3) or corner shackle web 232 (FIG. 4) of the cable structure 210, as discussed above.

As shown in FIG. 10, the enclosure raising and lowering means 400 includes a control panel 460 typically arranged on the frontmost utility pole 402. The control panel 460 includes a separate switch control 460*a*, 460*b*, . . . , 460*h* for the winch on each of the 8 utility 402, 404, . . . , 416. In a preferred embodiment the separate switch control 460*a*, 460*b*, . . . , 460*h* are strategically arranged so that the switch control 460*a* for the back-left winch 432 is in the top left corner of the control panel 460, as shown, the back-center winch 430 is in the top center of the control panel 460, etc., so the position of the switch control is physically related to the position of the winch when viewed from the front of the control panel 460. The scope of the invention is not intended to be limited to the position of the switch controls 460*a*, 460*b*, . . . , 460*h* in the control panel 460.

It will thus be seen that the objects set forth above and those made apparent from the preceding descriptions, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention therein described, and all statements of the invention of the scope of the invention which, as a matter of language, might be said to fall therebetween.

What is claimed is:

1. A limited space driving range, comprising:

a field;

a multiplicity of golfing bays from which golfers hit golf balls arranged on a front part of the field;

netting means having three side nets that surround the field, having a single top net that extends over the field and above said multiplicity of golf bays for substantially enclosing said field and said multiplicity of golfing bays and having no wall netting between said multiplicity of golfing bays, said netting means being made from material that is lightweight, durable and flexible enough to contain the golf balls being hit by the golfer, said single top net having a cable structure woven therein for providing structural support;

golf ball collection means arranged on a back part of said field, having an upwardly sloping ramp from front-to-back, a ball collection channel with at least one sidewardly sloping ramp arranged behind the upwardly sloping ramp, and a ball collection bin arranged at a lower end of the sidewardly sloping ramp, so the golf balls that are hit roll over the upwardly sloping ramp, down said at least one sidewardly sloping ramp and into the ball collection bin;

netting raising, holding and lowering means being adapted for lifting and holding said single top net over said field and above the multiplicity of golf bays and for lowering said single top net to perform maintenance and to prevent said single top net from being damaged by high wind, heavy snow and ice accumulation, having a plurality of utility poles arranged about said multiplicity of golf bays and having a respective pulley means disposed thereon, a plurality of wires, each being adapted to said single top net and cooperating with a respective one of said pulley means, and a plurality of winch means, each being disposed on a respective one of the plurality of utility poles and being connected to an associated one of said plurality of wire means for lifting and lowering the single top net; and a central control panel electrically connected to said plurality of winch means for controlling from one central point the raising and lowering of said single top net of said golf bay enclosing means.

2. A limited space enclosed driving range according to claim 1, wherein said ball collection channel has two sidewardly sloping ramps arranged behind the upwardly sloping ramp and a central peak, so balls roll down either side of said ball collection channel.

3. A limited space enclosed driving range according to claim 1, wherein the golf ball collection means further comprises a ball collection bin arranged at a lower end of said at least one sidewardly sloping ramp so the golf balls that are hit roll over the upwardly sloping ramp, down said at least one sidewardly sloping ramp and into the ball collection bin.

4. A limited space enclosed driving range according to claim 1, wherein said at least three side nets and the single top net are connected together as an integral unit which is lifted and lowered together.

5. A limited space enclosed driving range according to claim 1, wherein said netting means is surrounded on four sides by a chain link fence to protect the limited space enclosed driving range from vandalism.

* * * * *